United States Patent [19]

Richter

[11] 3,971,200

[45] July 27, 1976

[54] PROCESS AND APPARATUS FOR CONTINUOUS HEAT SETTING OF CARPET YARNS

[75] Inventor: Hans Heinrich Richter, Warwick, R.I.

[73] Assignee: Leesona Corporation, Warwick, R.I.

[22] Filed: Oct. 7, 1974

[21] Appl. No.: 512,181

Related U.S. Application Data

[63] Continuation-in-part of Ser. No. 448,641, March 6, 1974, abandoned.

[52] U.S. Cl. ..... 57/34 HS; 57/157 TS

[51] Int. Cl.[2] ..... D02G 1/04; D01H 13/28

[58] Field of Search ..... 57/34 HS, 157 R, 157 TS, 57/157 MS, 34 R, 51, 51.4, 51.6, 55.5, 156, 157 S

[56] References Cited

UNITED STATES PATENTS

| | | | |
|---|---|---|---|
| 2,956,393 | 10/1960 | Ubbelohde | 57/157 TS |
| 3,270,492 | 9/1966 | Fitton et al. | 57/157 TS |
| 3,438,190 | 4/1969 | Collingwood | 57/157 TS |
| 3,702,055 | 11/1972 | Kosaka | 57/157 TS |
| 3,724,191 | 4/1973 | Hooper | 57/157 TS X |
| 3,729,916 | 5/1973 | Lusk et al. | 57/34 HS |
| 3,774,383 | 11/1973 | Stemmer | 57/34 HS;157 TS X |
| 3,796,036 | 3/1974 | Parker | 57/157 TS |
| 3,813,863 | 6/1974 | Ritter | 57/34 HS |
| 3,903,682 | 9/1975 | Crouzet et al. | 57/34 HS |

*Primary Examiner*—Donald E. Watkins
*Attorney, Agent, or Firm*—Burnett W. Norton

[57] ABSTRACT

The instant invention relates to a continuous process for the manufacture of heat set yarns. The process comprises firstly passing a two or more ply twisted filament or spun yarns having a latent bulk in the single ends into a first heating zone to develop the latent bulk, passing the yarn into a second heating zone where the yarn is heated to a temperature higher than it was heated in the first zone, and then passing the yarn into a cooling zone while imposing a false twist which runs back into its second heating zone. The second heating zone and the cooling zone serve to set the bulk and the twist and to increase the torque of the yarn. The yarn is then fed to a take-up and wound into a package.

15 Claims, 15 Drawing Figures

AUTOCLAVE

45 YPM

0 TPI 3 TPI 6 TPI

100 YPM

120 YPM

AUTOCLAVE

4 TPI 110 YPM

PROCESS AND APPARATUS FOR CONTINUOUS HEAT SETTING OF CARPET YARNS

CROSS REFERENCE TO RELATED APPLICATION

This application is a Continuation-in-Part of copending U.S. application Ser. No. 448,641 filed Mar. 6, 1974, now abandoned.

BACKGROUND OF THE INVENTION

Textured yarns for the manufacture of carpets, for example, are, of course, well known in the art. These yarns are conventionally prepared by a process known as the skein-autoclave bulk heating setting process. This process includes the steps of skeining a two or more ply twist yarn, steam tumbling the yarn and then subjecting the yarn to the action of steam in an autoclave at an elevated temperature. The yarn is then dried and expanded in any well known manner and then rewound from the skein into a package. The steam tumbling step serves to develop the latent bulk in the yarn while the autoclaving step sets the developed bulk and the twist in the single end of the yarn. Yarn produced by this method presently represents the quality standards which has been previously processed to impart latent bulk thereto through a first heating zone to develop the latent bulk in the yarn, thence through a second heating zone wherein the yarn is heated to a substantially higher temperature in the second heating zone than in the first heating zone and then a cooling zone to set the yarn. A false twist is imparted to the yarn while the yarn is in the second heating zone and the cooling zone.

OBJECTS OF THE INVENTION

It is an object of the present invention to provide a method for bulking, heat setting and winding yarn into a package in one continuous process which provides the yarn with the quality of properties equal to heat-set yarns produced in the autoclave heat set process.

A further object of the present invention is to provide a process as aforesaid which is adaptable to vary the amount of bulk and positive torque in the ply twisted yarn which adds the advantage of a high degree of flexibility to the process to provide for different styling of carpets.

Other objects of the invention will, in part, be obvious and will, in part, appear hereinafter.

DESCRIPTION OF THE PREFERRED EMBODIMENTS

Figure 1:
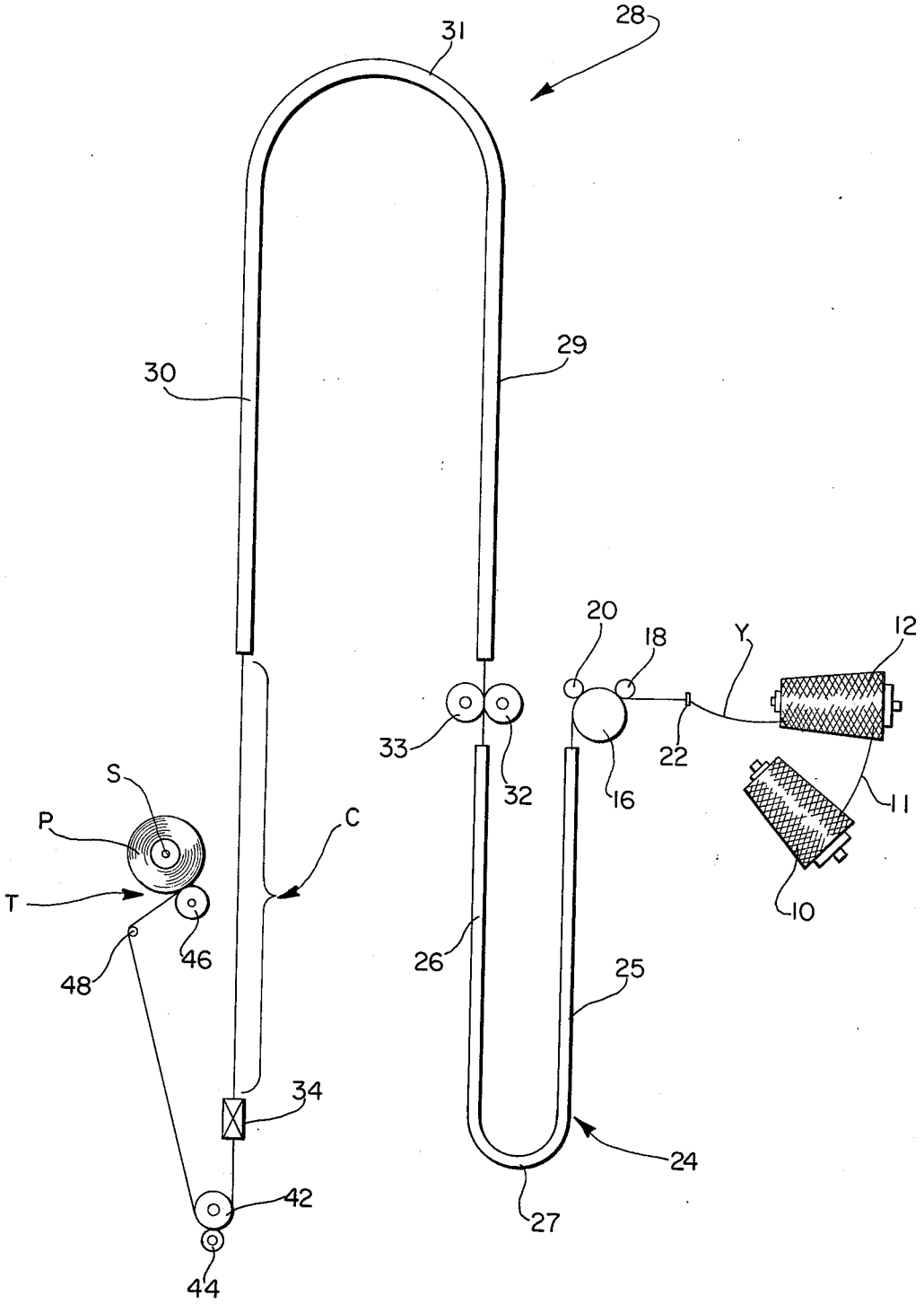
FIG. 1 is a schematic perspective view of one form of the apparatus of the present invention.

Referring now to FIG. 1 a strand of a two or more ply yarn Y which has been previously processed to have latent bulk imparted thereto is forwarded from package 12 in a normal fashion by means of feed roll 16 and cooperating pinch rolls 18 and 20. A reserve supply of latently bulked yarn is provided at package 10, the two packages 10 and 12 being joined by transfer tail 11. A suitable guide 22 is positioned between package 12 and feed roll 16 for guiding yarn Y to said feed roll. Yarn Y passes from feed roll 16 through a bulking heater 24 wherein yarn Y is heated and the latent bulk in yarn Y developed. Heater 24 is comprised of a pair of vertical extending portions 25 and 26 interconnected by a curved portion 27 to form a generally U-shaped heater. From the heater 24 yarn Y then passes into a second or "setting" heater 28 by means of nip rolls 32 and 33. As is seen in FIG. 1 heater 28 likewise comprises vertical extending portions 29 and 30 interconnected by a curved portion 31 to again form a U-shaped heater. Yarn Y is heated to a higher temperature in the heater 28 than in the bulking heater 24, the function of heater 28 being to set the yarn.

In the bulking heater 24 yarn Y is preferably heated in the range of about 160° to about 190°C and in the second heater yarn Y is heated in the range of about 220° up to about 5°C below the melting point of the yarn. It is preferred however to heat yarn Y in the first heater in the range of about 160 ° to about 180°C, and most preferably from about 165° to about 175°C.

After leaving heater 28 yarn Y passes through a cooling zone C, and thereafter a false twist spindle 34, whereby the false twist imposed in yarn Y by spindle 34 migrates upstream into the portion of yarn Y in the heater 28. The false twist is precluded from passing into the portion of yarn Y in heater 24 since the rolls 32 and 33 act as a twist trap. After passing through cooling zone C a false spindle 34 yarn Y is then fed to a take-up unit T by means of feed and nip rolls 42 and 44. Unit T includes the usual spindle S upon which package P is formed and a cooperating roller bail 46 for frictionally driving the spindle and package. A guide 48 is operatively positioned between the roller bail 46 and the aforementioned feed and nip rolls 42 and 44 to guide yarn Y to the take-up unit.

While in heater 24 yarn Y is maintained at a relatively low tension, preferably in the order of 1 to 2 grams by controlling the relative speeds of rotation of feed roll 16 and nip rolls 32, 33. While in heater 28 yarn Y is maintained at a higher tension than when in heater 24, this tension being preferably in the order of 4 to 16 grams. Such tension control is achieved by regulation of the speeds of roll 42 relative to rolls 32 and 33.

FIGS. 2–5 illustrate alternative embodiments of the apparatus for practicing the present invention.

Figure 2:
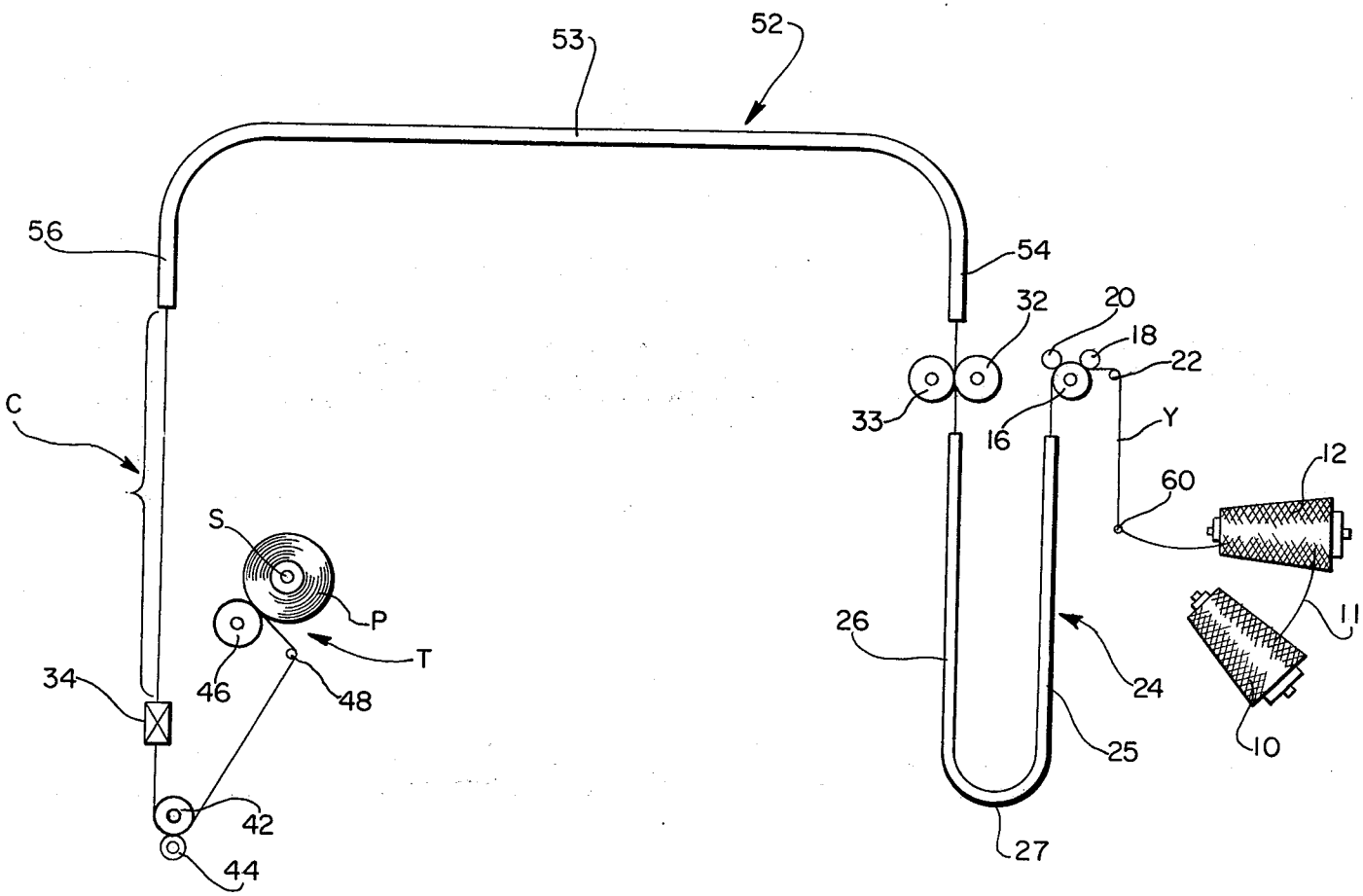
FIG. 2 is a schematic perspective view of an alternative embodiment of the associated apparatus.

As is seen in these views various configurations of heaters for bulking and setting yarn Y are readily employed. Specifically, as shown in FIG. 2, the setting heater 52 may include a substantially straight horizontal portion 53 between the vertical extending portions 54 and 56 of the heater. As also shown in the embodiment of FIG. 2, yarn Y may be drawn upward by means of roll 16 and pinch rolls 18 and 20 if desired. Positioning a guide 60 between package 12 and these rolls assists in guiding of yarn Y upwardly.

Figure 3:
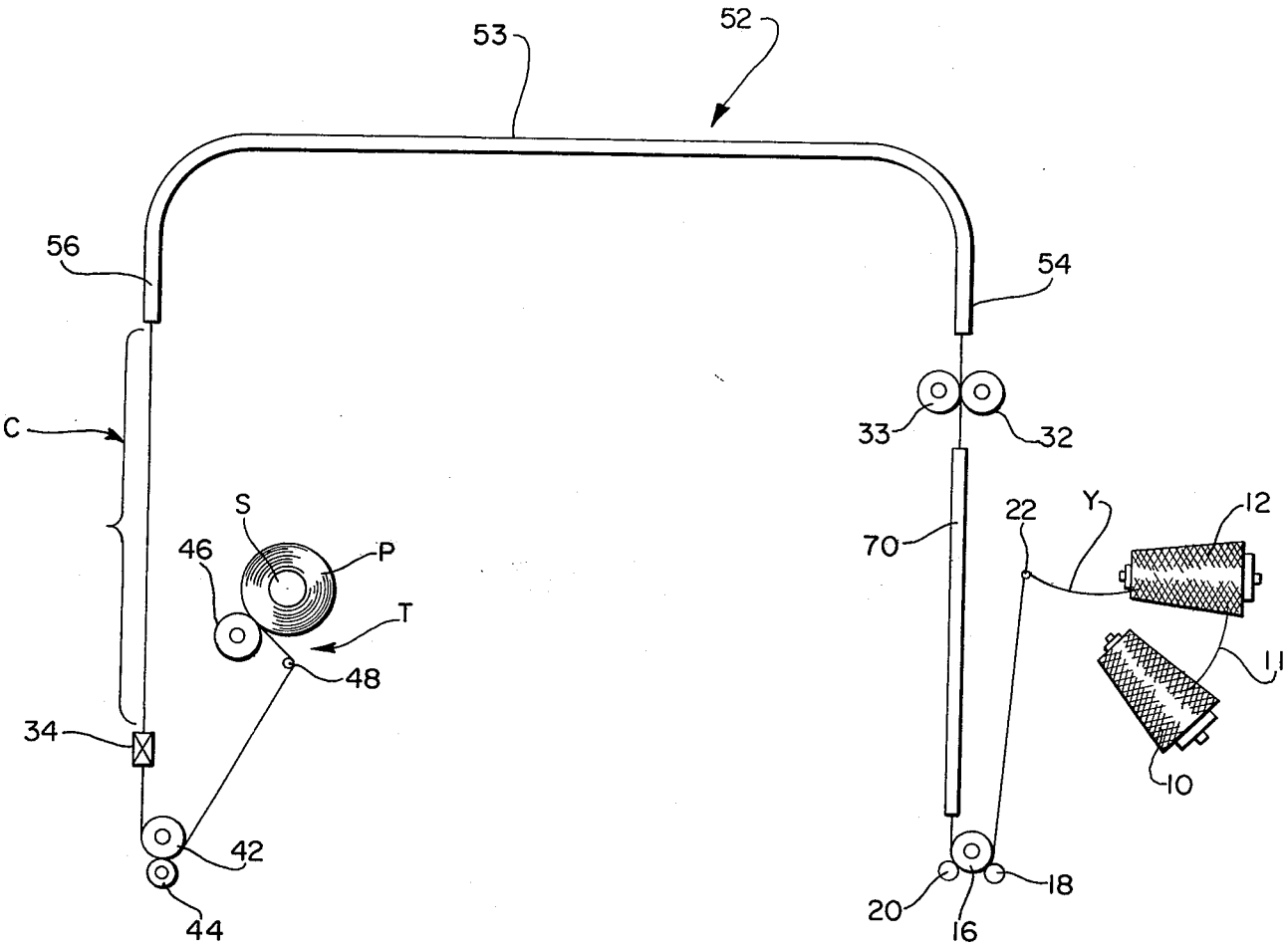
FIG. 3 is a schematic perspective view of a further alternative embodiment of the associated apparatus.

FIG. 3 illustrates a third embodiment of the apparatus of the present invention wherein setting heater 52 is of the configuration of the embodiment of FIG. 2 but bulking heater 70 is a linear heater positioned so that the yarn Y proceeds downward from package 12 and then in a straight line upward through the heater 70 and into setting heater 52.

Figure 4:
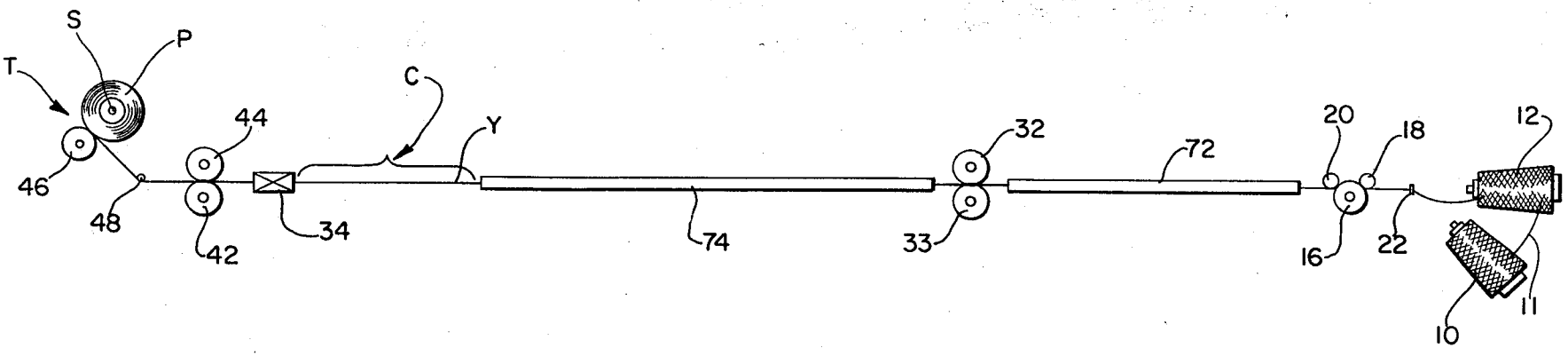
FIG. 4 is a schematic perspective view of a still further alternative embodiment of the associated apparatus.

FIG. 4 shows a still further embodiment of the apparatus wherein both the bulking heater 72 and the setting heater 74 are linear and positioned so that the yarn Y travels in essentially a horizontal path from package 12 to the take-up package P.

EXAMPLE I

In practice with the present invention a non-set filament nylon yarn of 1300 denier, having a latent bulk, 2 ply, at 3.3 turns per inch twisted, was processed according to the invention at a speed of 100 yards per minute. The temperature in the bulking heater, having a length of approximately 8 feet, was maintained at 190°C and the yarn was tensioned at 1 gram in the heater. Temperature in the setting heater, having a length of approximately 15 feet, was maintained at 225°C, applied tension therein was from 4–8 grams and the yarn was brought up to a twist level of 6.6 turns per inch. The yarn was passed from the setting heater through the cooling zone, which was at ambient temperature, while being false twisted. The length of the cooling zone from the setting heater to the false twist spindle was approximately 5 feet. Thereafter, the precessed yarn was taken up into a package at a tension of 50 grams. After tufting, cutting, and dyeing the yarn was found to have excellent bulk and end definition, setting properties, twist torque and dye uniformity.

EXAMPLE II

In a further example carried out in accordance with the present invention non-set spun nylon yarn of 1300 denier, having latent bulk, 3 ply, at 3.0 turns per inch twisted was processed according to the invention at a speed of 70 yards per minute. Length of the heaters and the cooling zone were the same as in example I. The temperature in the bulking heater was maintained at 170°C and the yarn was at a tension therein of 2 grams. Temperature in the setting heater was maintained at 225°C, and applied tension therein was from 6–14 grams and the yarn was brought up to a twist level of 6 turns per inch. The yarn was then passed through the cooling zone at ambient temperature while being false twisted by a false twist device. Thereafter the processed yarn was wouond up into a package under a tension of 50 grams. After tufting, cutting, and dyeing the yarn was found to have the desired amount of bulk and excellent end definition, setting properties, twist torque and dye uniformity.

Figure 5:
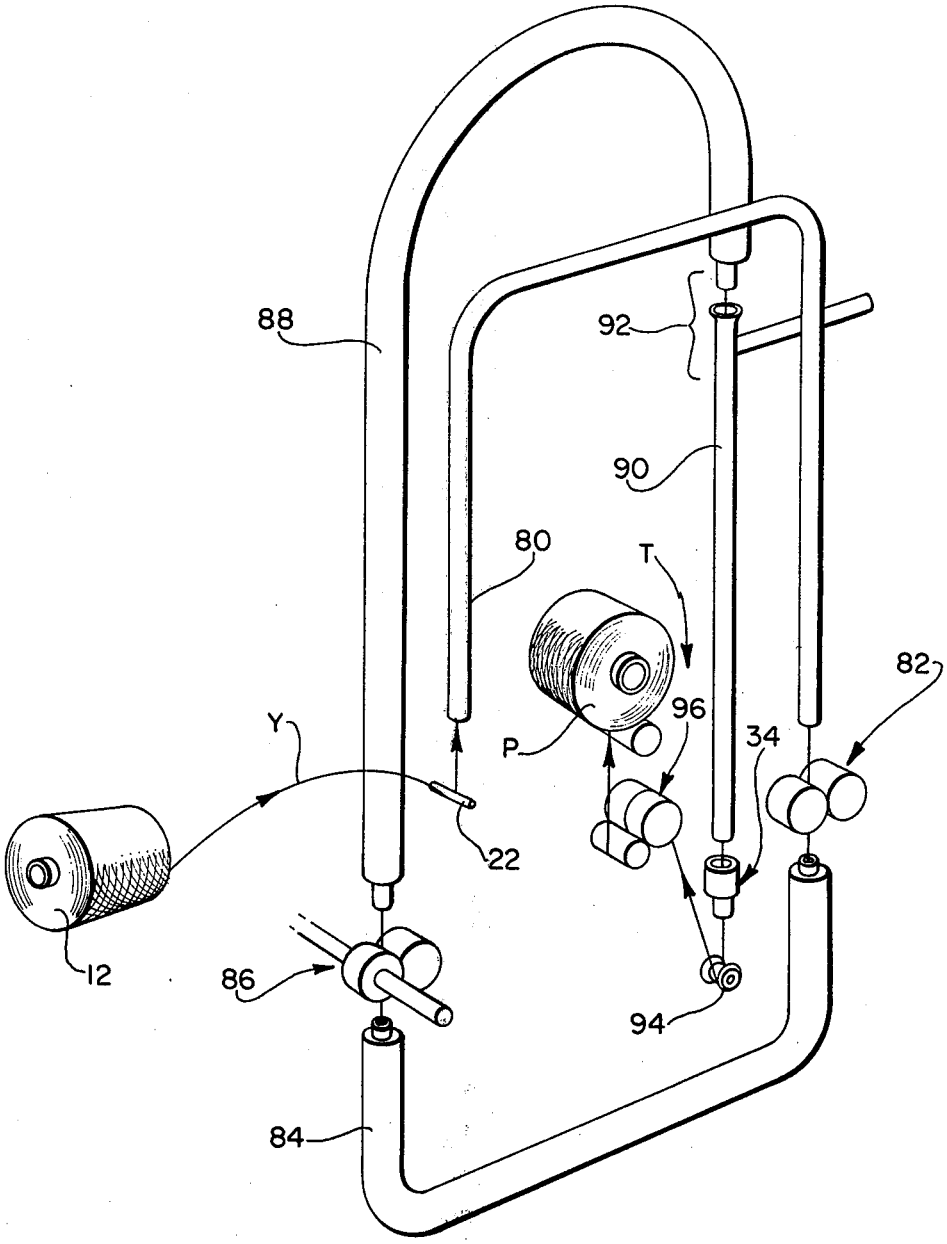
FIG. 5 is a view similar to that of FIGS. 1–4 of yet a further modified form of the present invention.

In FIG. 5 a further embodiment of the invention is illustrated. Here a supply package 12 of yarn possessing latent bulk characteristics is provided as a supply source, the yarn therefrom being advanced over-end from the package, about a guide 22 and into an enclosed thread-up tube 80, the function of which is provided a pathway for the yarn to a first set of positively driven feed rolls 82. From the feed rolls 82 the yarn is directed into a U-shaped, tubular bulking heater 84 from which it emerges in an upwardly extending reach to be engaged by a second set of positively driven feed rolls 86. Yarn Y advances from feed rolls 86 to an inverted U-shaped, tubular, setting heater 88 which heats the yarn while at the same time guiding it to a fume removal tube 90 which acts to dissipate fumes produced as an incident to the yarn being heated to an elevated temperature in heater 90. Upon emergence from heater 90 the yarn Y is engaged and false twisted by a false twist spindle 34. In operation the spindle 34 is efective to impart twist in the yarn, the twist extending back through fume removal tube 90 and setting heater 88. The twist in the yarn is ultimately trapped by feed rolls 86 to thus preclude further migration thereof. The zone defined between the downstream end of setting heater 88 and false twist spindle 34 constitutes a cooling zone 92 for the yarn, this zone embracing the full length of tube 90 as seen in FIG. 5. It will thus be understood that false twist spindle 34 in combination with the aforedescribed setting heater and cooling zone operate to produce a false twisting of the bulked yarn. That is to say, the bulked yarn is twisted about its own axis, heated, then cooled (commonly called "heat setting" the twist) and untwisted in a continuous operation without interruption between the individual steps. Consequently in practice with the present invention false twisting is superimposed on the bulked yarn. As will be brought forth more specifically hereinafter, the sense or direction of the false twist is in the same direction as the ply twist in the supply yarn. Accordingly, the processed yarn, having had a "memory" imparted to it by virtue of the twisting-heat setting process, exhibits the characteristic of twisting on its own axis in its heat set condition. Thus, if, for example, if a carpet is tufted from the processed yarn and then subjected to a walk out test, the yarns in the carpet act to retain their original definition due to the torsional forces therein, even under extended periods of wear.

After passing through the false twist spindle 34, yarn Y is guided around a freely rotatable idler roll 94, through positively driven feed rolls 96, and wound up into a package P on a take-up unit T which may be the same as that described in connection with the embodiments of FIGS. 1–4. Threading of the yarn through tubes 80, 84 and 88 may be accomplished by blowing the yarn therethrough.

As is usual, the tension in the yarn being processed through the aforedescribed apparatus is set at some prescribed value dependent on the characteristics of the yarn being processed as well as desired characteristics of the final yarn product. Such tension is established in bulking heater 84 by adjusting the relative speeds of rotation of feed rolls 82 to feed rolls 86 to thus hold yarn tension in this heater to a uniform value. That is to say, feed rolls 82 are rotated at a speed somewhat faster than feed rolls 86 to provide what is known as "overfeed" which is usually expressed in terms of percentage. This overfeed permits a controlled degree of relaxation in bulking heater 84 sufficient to permit yarn Y to relax therein to a point where the crimp in the yarn can develop. In a similar manner feed rolls 86 and 96 are driven at predetermined rates of speed to yield a controlled, uniform overfeed or degree of relaxation in the yarn in zone between these feed rolls, which overfeed may be of a negative value to permit proper tensioning of the bulked yarn for twisting, in the zone between these feed rolls.

At this juncture it is perhaps of value to explain that in the processing of "torque stretch yarn" synthetic yarns are twisted by means of a false twist device to assume a crimped and pigtailed configuration so that they have stretch and recovery characteristics which distinguish them from untreated yarns. Processes for producing torque stretch yarns are well known in the textile art and need not be elaborated on here. However, it is useful to point out that when torque stretch yarn is examined on a filament-by-filameent basis and free of tension, it is characterized by two separate types of deformations. The first of these deformations is referred to as "crimp" and the second deformation is commonly referred to as "pigtails".

If a single filament of torque stretch yarn is grasped at both ends and allowed to relax fully, the deformation known as pigtails will be by far the most visible. The filament will coil on itself at frequent, random locations along the filament creating the "pigtails." If this same filament is elongated to the point where the pigtails have just uncoiled, the deformation known as "crimp" becomes more visible. The filament now has a wavy appearance due to the helical configuration imparted thereto by the filament and heat-set process, but is not coiled upon itself. It will be appreciated that the crimp is present in the filament pigtails, but because the pigtail deformation is larger than the crimp deformation, most of the crimp is visually obscured by the pigtails until the pigtails are stretched out of the filament. If the filament is elongated further, the crimp will disappear and a straight filament will result. Upon relaxation, however, the crimp, and ultimately the pigtailing, will reappear.

In the examples presented hereinafter the bulked yarn is false twisted with sufficient turns of twist to impart a torsional bias or "memory" into the yarn in the direction of the ply twist. However, the low number of turns (1–6 turns per inch or, simply "TPI") presented in the examples does not produce pigtailing or detectable crimping in the filaments. Nevertheless, it will be obvious that a sufficiently high number of turns of false twist could be inserted in the yarn to induce pigtailing and crimping if a yarn with this characteristic was desired.

While it will be appreciated that the apparatus of FIG. 5 may be dimensioned to suit a wide variety of conditions and spatial considerations, one such successful apparatus has included a bulking heater 84 having a total length of 10 feet with the horizontal portion thereof being 6 feet in length and the opposed upturned portions being of equal length. The setting heater 88 of the apparatus has a total length of 20 feet with a 3 foot radius and has a polished interior to permit substantially uniform twist migrtation from false twist spindle 34 to feed rolls 86. Desirably, the temperatures of heaters 84 and 88 are maintained to ± 1°C. False twist spindle 34 maay be the same as is disclosed and claimed in U.S. Pat. No. 3,044,247.

For purposes of illustration, samples of yarn processed in accordance with the apparatus of FIG. 5, samples processed in accordance with the apparatus of FIG. 5 but with the false twist spindle rendered inoperative, autoclaved yarn, and a control sample of unprocessed yarn will now be discussed having particular reference to FIGS. 6 and 7.

Figure 6:
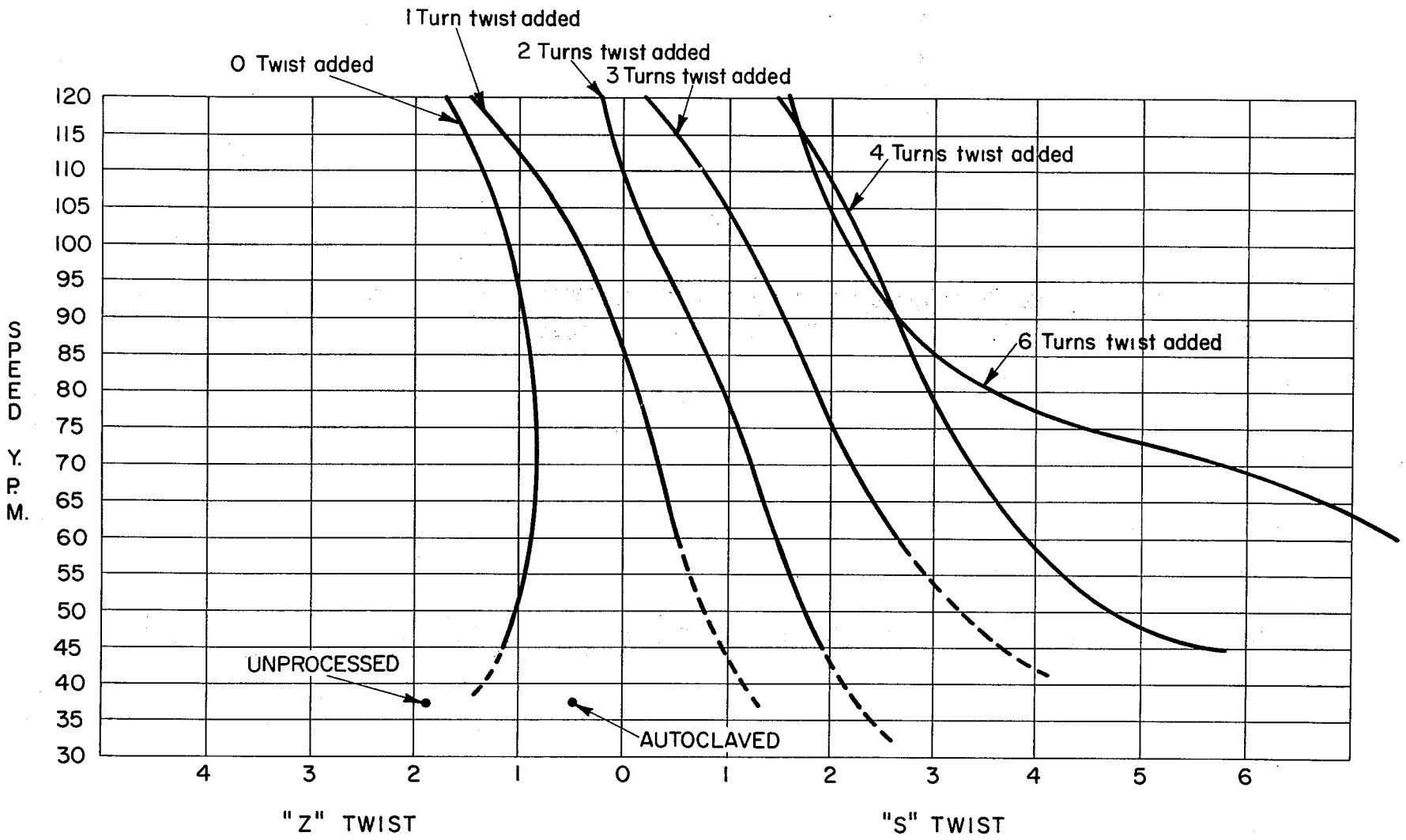
FIG. 6 is a graph depicting the twist response of yarn samples plotted against processing speeds of the yarn samples under test conditions as set forth hereinafter.
Figure 7:
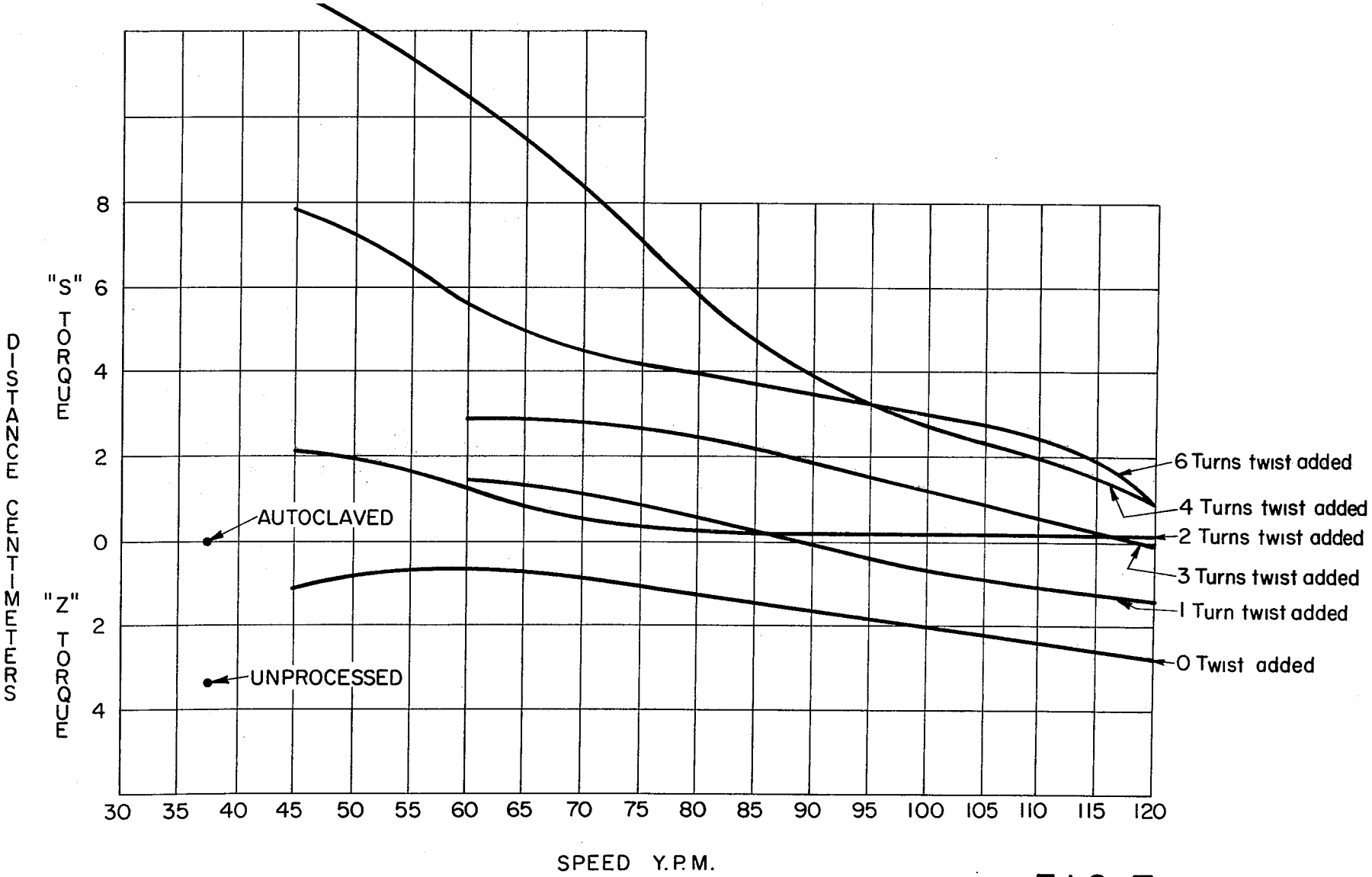
FIG. 7 is another graph showing the results of tests conducted as hereinafter described to exhibit twist liveliness in yarn samples.

In the results reported in FIGS. 6 and 7 the supply yarn was nylon 6—6, type 847, 1300 denier, 2 ply S twist, bulked, continuous-filament (BCF) yarn with 2.6 TPI Z twist in the singles and 2.9 TPI S twist in the ply to yield a balanced twist yarn, produced by E. I. Du Pont de Nemours and Co. (Inc.), Wilmington, Del. This yarn will be referred to hereinafter as "unprocessed yarn". It is of use at this point to indicate that while this yarn is said to be "bulked" it is, in fact, manufactured to possess a considerable amount of residual or latent bulk, that is, bulk which is developed after the yarn has been delivered by the producer to the customer. In accordance with the present invention, it is this latent bulk which is developed or activated in the bulking step of the present invention which, as described herein, involves the application of heat to the yarn under controlled conditions of time exposure to the heat and yarn tension. Moreover, after bulk development it is necessary to anneal the developed yarn to produce as "set yarn." In this procedure that developed yarn is exposed to a sufficiently high temperature and then cooled, all under controlled conditions of time and temperature to thus preclude further alteration of the bulked condition in the yarn. Accordingly, and in practice with the present invention, setting heater 88, cooling zone 92 and the tension control imposed by feed rolls 86 and 96 uniquely provide a zone in which setting of the bulk and ply twist in the yarn is achieved simultaneously with the aforementioned false twisting thereof.

The sample reported in FIGS. 6 and 7 identified as "autoclaved yarn" was prepared according to du Pont Technical Information Bulletin N-235, June, 1969, published by the above-mentioned E. I. du Pont de Nemours and Co. (Inc.).

Four samples of the unprocessed yarn were processed on the apparatus of FIG. 5 at through-put speeds ranging from 45–120 yards per minute. In the twisted samples spindle 34 was operated to impart false twist levels of 1, 2, 3, 4 and 6 TPI S twist into the individual samples. The remaining process conditions for all four of the twisted samples as well as the zero twist samples were as follows:

| | |
|---|---|
| Temp. of bulking heater 84 | 190°C. |
| Temp. of setting heater 88 | 225°C. |
| Yarn tension at take-up T | 100 grams |
| Yarn overfeed to bulking heater 84 | 6.7% |
| Yarn overfeed to setting heater 88 | 3.9% |

Samples of this 1300 denier nylon were taken from package P after processing. In the "O twist" yarn, spindle 34 was inactivated by having the drive removed, the spindle held stationary, and with the yarn being threaded through the inactivated spindle.

In FIGS. 6 and 7 the results of tests conducted with the samples herein under discussion are displayed. The tests were designed to measure the recoverable torque in each sample of yarn. Since there is no standard method prescribed for testing the liveliness of twisted yarn a test was devised to quantitatively measure the torque present in each yarn sample, this torque being indicative of liveliness. The apparatus consisted of two clamps, one stationary and the other movable, mounted upon a worm shaft 100 cm. apart. Each sample to be tested was unwound from a package, taking care not to lose any of the twist therein, and one end was secured to the fixed clamp while the opposite end was secured to the movable clamp with a 20 gram deadweight attached to provide a fixed tension in the yarn sample. A 2.5 gram weight was hung on the yarn sample 50 cm. from each clamp. The worm shaft was driven by an electric motor while advancing the movable clamp toward the fixed clamp. The motor was stopped when the yarn sample began to twist on itself. Each test was conducted five times and the average of the five readings of the distance between the two clamps, the direction of the twist (S or Z), and the number of turns of twist, i.e., the number of times the yarn twisted on itself at its center were recorded. As is apparent, a completely torque free yarn would hang without looping, i.e., without twisting on itself, at all. The closer the two clamps come together the less torque that is present in the yarn. Conversely, the greater twist in the ply direction the greater the torque. The data from the aforementioned tests is reported on the graphs of FIGS. 6 and 7. In FIG. 6 it is seen that the unprocessed yarn samples, the autoclaved yarn, and the zero false twisted yarn exhibited some tendency to untwist slightly, i.e., twist in a Z direction, while all samples which had twist added by false twist spindle 34 exhibited a tendancy to twist in the S direction, at least at some through-put speed in the 45–120 yard per minute range. In FIG. 7 where the liveliness of each sample is proportional to the distance between clamps on the test stand at which the yarn twisted on itself, it is seen that the unprocessed samples exhibited an untwisting, i.e., twisting in the Z direction, as did the zero twist samples. The autoclaved yarn exhibited a slight tendancy to untwist. On the other hand all other samples processed on the apparatus of FIG. 5, that is, those with false twist inserted showed a tendancy to twist in the S direction, the torque forces inducing such liveliness being a function of the operating conditions under which the samples were processed.

Figure 8:
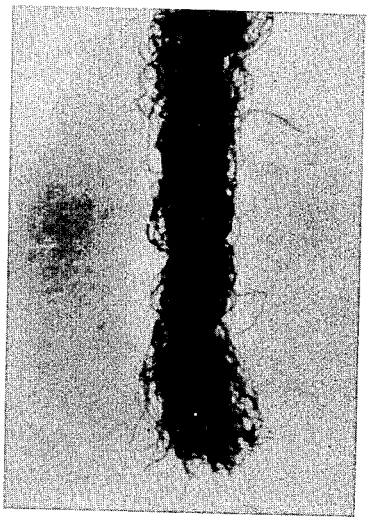
FIG. 8 is an enlargement of a photograph of a yarn sample produced in accordance with the autoclave method reported hereinafter.
Figure 9:
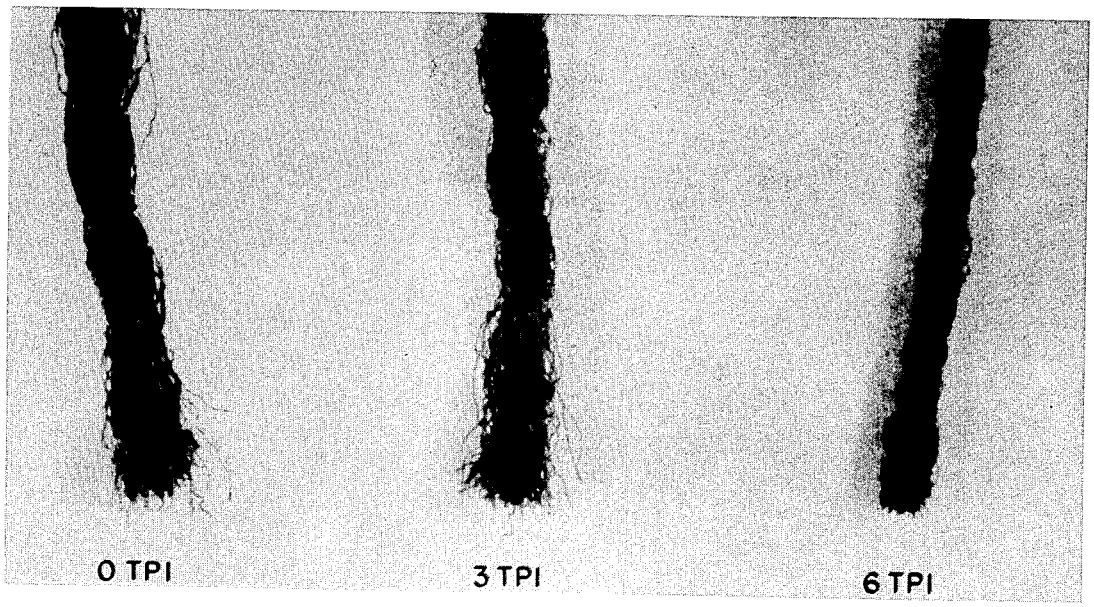
FIGS. 9 through 13 are enlargements of photographs of yarn samples produced in accordance with the present invention, the samples being produced at various through-put speeds and twist levels as identified on the legend of each photograph.
Figure 10:
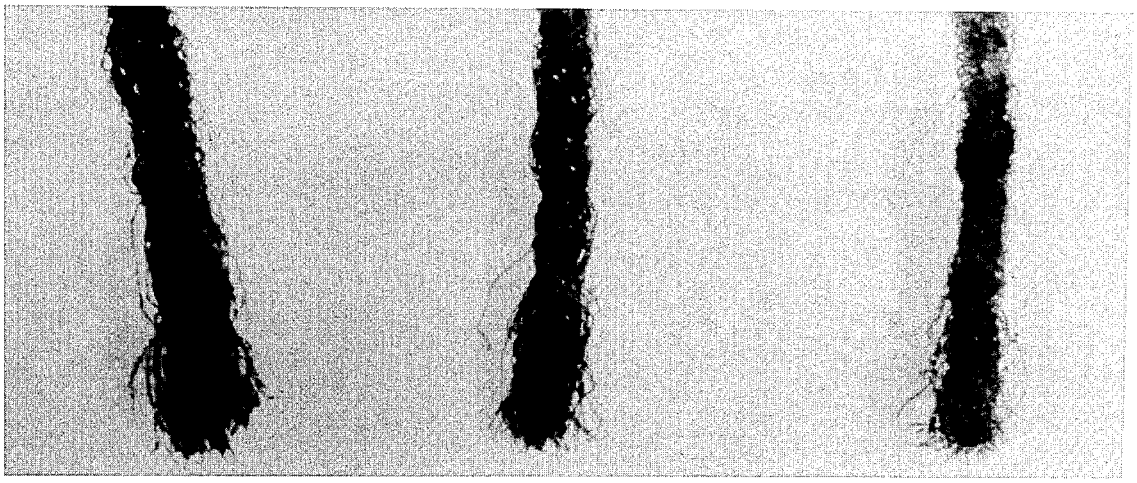
Figure 11:
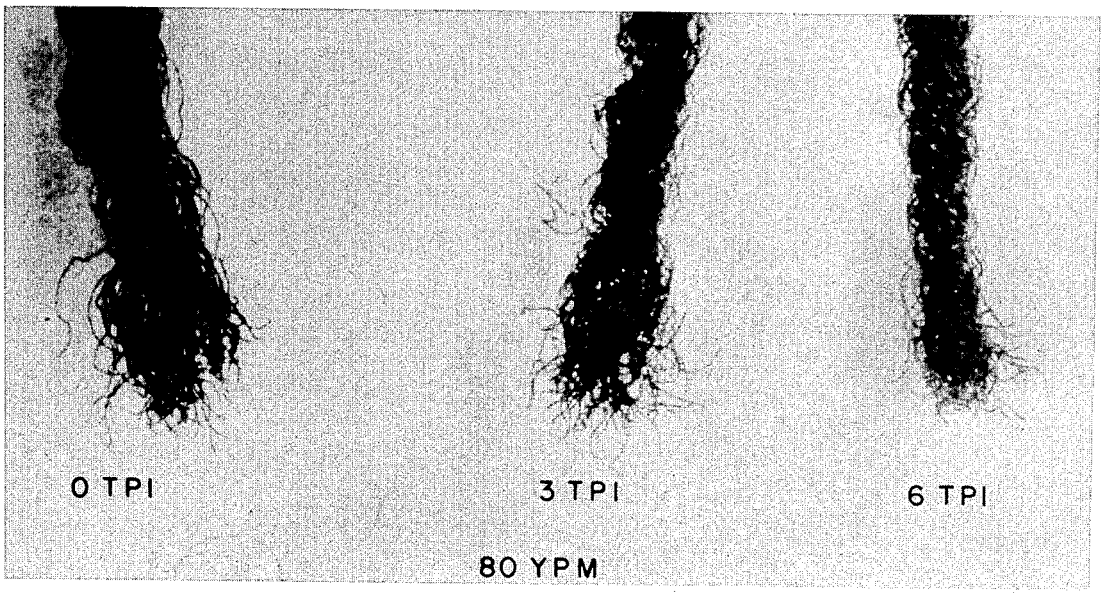
Figure 12:
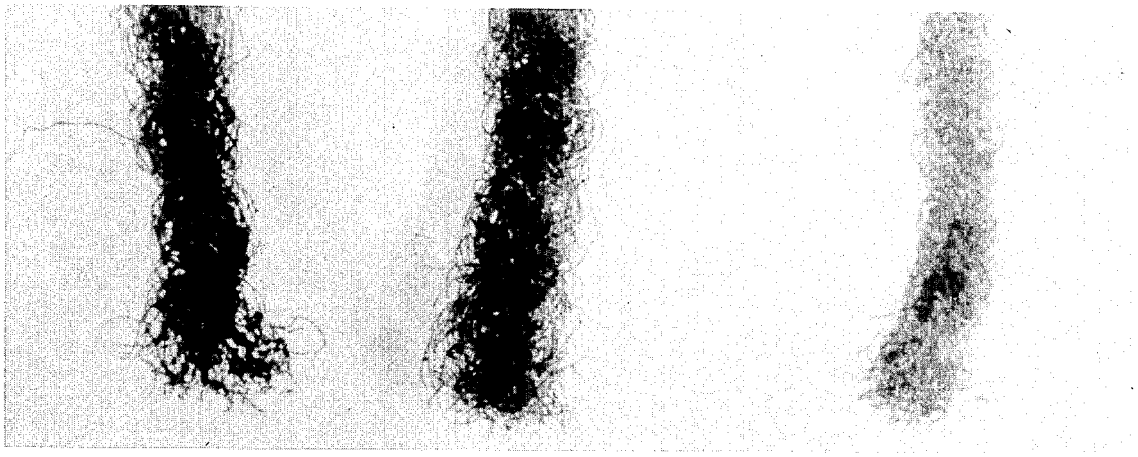
Figure 13:
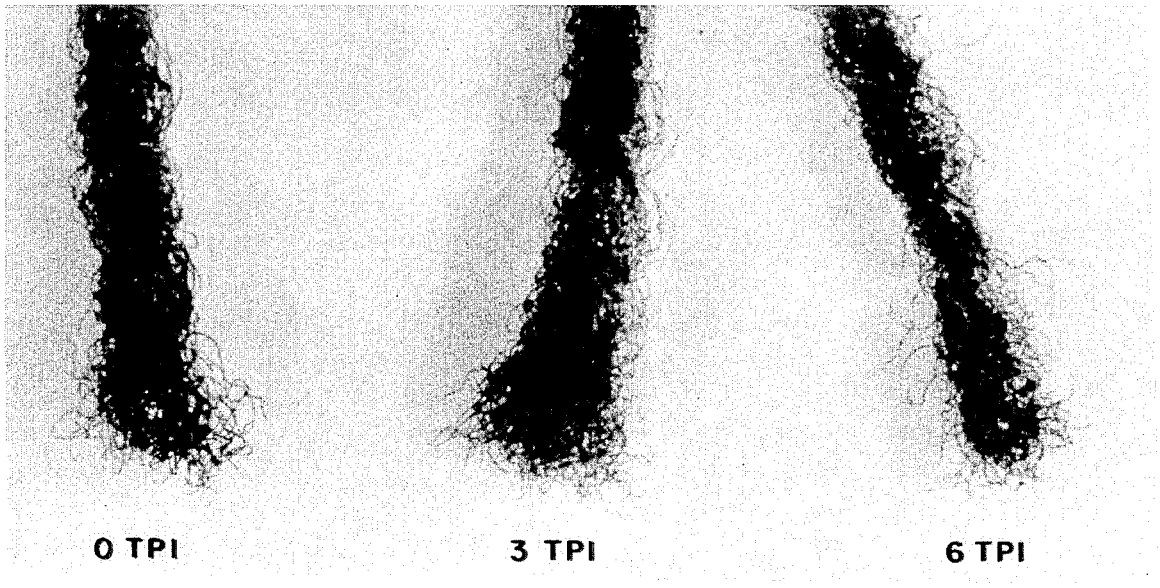

Bearing in mind that the samples discussed herein which have been subjected to the action of false twist spindle 34 are false twisted in the same direction as the direction in which the ply twist has been inserted, i.e., S twist in these samples, a rather surprising result is attained. That is, in the prior art false twisting of synthetic yarns the false twisting is employed to impart a crimped configuration to the yarn which results in an increase in the cross section of the processed yarn. In the present invention the false twist step actually acts to reduce the bulk and causes the yarn plies to wind more tightly together when the yarn is cut, as during a tufting operation. This is dramatically brought forth in the photographs of FIGS. 9 to 13 which are certain of the yarn samples discussed above and reported in the graphs of FIGS. 6 and 7. In these photographs a visual comparison is provided of an end of autoclaved yarn (the autoclaved sample being seen in FIG. 8) and ends of the afore-mentioned yarn samples processed with 0, 3 and 6 TPI of false twist at through-put speeds of 45, 60, 80, 100 and 120 yards per minute. In these photographs the end definition of each sample is quite apparent and the straightness and uniformity of yarn diameter is also readily evident. Note that in FIG. 8 which is a photograph of the autoclaved yarn the sample is of quite uniform diameter and the end of the sample is of essentially the same diameter as the remainder of the sample. A dramatic representation of the results obtained with the present invention is shown (for example, in FIG. 9 where yarn processed through the apparatus of FIG. 5 at a through-put speed of 45 yards per minute at 0, 3 and 6 TPI is seen. Note the rather loose end definition in the sample with 0 turns of twist, the tighter end definition with 3 TPI of twist, and the even tighter end definition at 6 TPI of twist. Similar results prevail with the remaining samples as seen in the photographs.

Figure 14:
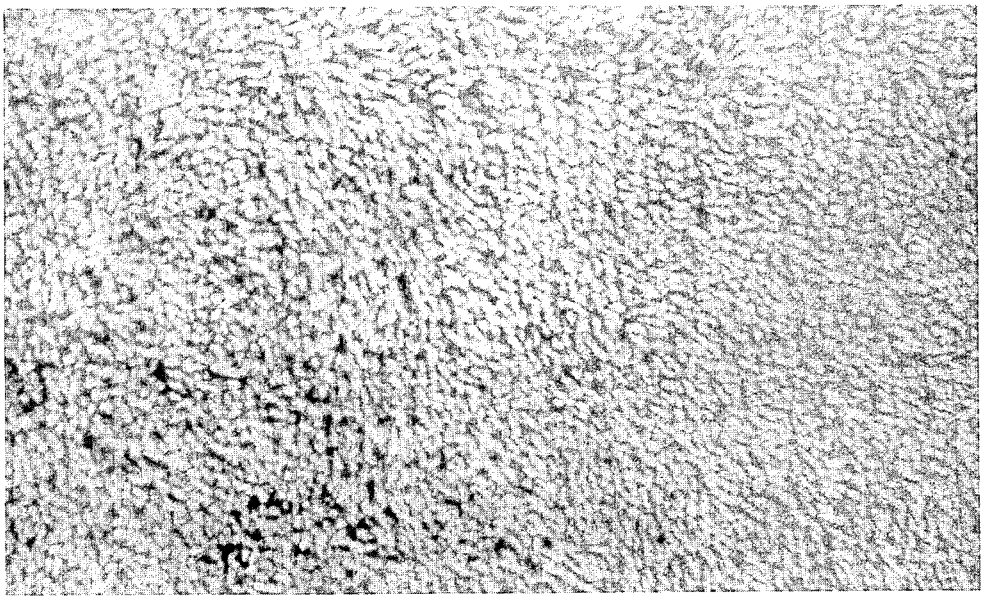
FIG. 14 is an enlargement of a photograph of a carpet sample tufted from yarn produced in accordance with the hereinafter stated autoclave method.
Figure 15:
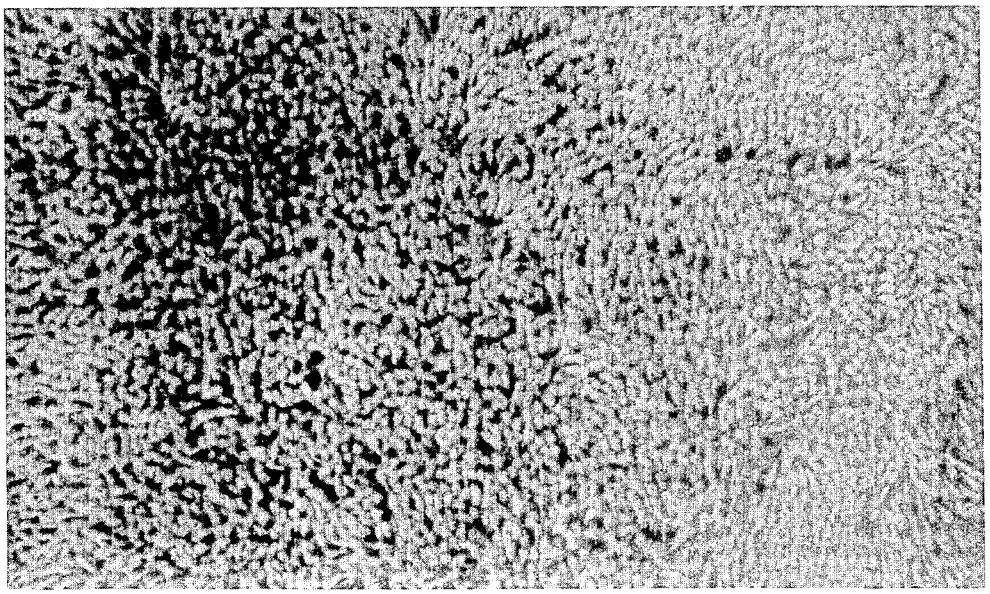
FIG. 15 is an enlargement of a photograph of a carpet sample tufted from yarn produced in accordance with the present invention at process conditions of 4 TPI and a throughput speed of 110 YPM.

In FIGS. 14 and 15 samples of a textile floor covering prepared from a sample of the aforementioned yarn processed in accordance with the present invention with 4 TPI false twist at 110 yards per minute through put speed and a sample of a textile floor covering prepared in accordance with the aforementioned autoclave process are presented to show the similarity in appearance of the two products.

A further observation that has been made with yarn produced in accordance with the present invention is that when the yarn is tufted into a shag carpet, the carpet walk-out tested, and then washed in a heated bath, the tufted yarn ends recover their straightness, due to the action of the heat and moisture of the bath combined with the "memory" effect or torsional bias introduced into the yarn during the twisting and heat-setting process. Thus, rejuvenation of the carpet to a condition approximating its original appearance is achieved. Further, the degree of rejuvenation with carpet samples formed from yarn processed in accordance with the present invention has been shown to be superior over carpet samples produced from autoclaved yarns. Thus, in this regard, the yarns produced in accordance with the instant invention are superior to autoclaved yarns.

It should be apparent that the present invention may be embodied in other specific forms without departing from the spirit or essential attributes thereof, all of which are intended to be encompassed by the appended claims.

What is claimed is:

1. A process for texturing yarn comprising, moving a strand of yarn under tension to a first heating zone for heating said yarn to a temperature in the range of 160° to 200°C, passing said yarn to a second heating zone to heat said yarn to a temperature higher than in said first heating zone, thereafter cooling said yarn, imposing false twist in the yarn in said second heating means and said cooling zone while substantially precluding migration of said false twist into said first heating zone, tensioning said yarn in said second heating means and said cooling zone to a greater extent than in said first heating zone, and finally collecting said yarn.

2. A process according to claim 1 including the step of heating the yarn in the second heating zone in the range up to about 5°C below the melting point of the yarn.

3. A process in accordance with claim 1 including the steps of maintaining the tension in said yarn in said first heating zone in the range of from 1 to 2 grams and the tension in the yarn in said second heating zone in the range of from 4 to 16 grams.

4. A process in accordance with claim 1 wherein said yarn is at least two ply yarn.

5. A continuous process for producing a bulked and heat set yarn comprising the steps of, advancing a bulked heat settable yarn into a first heated zone under a controlled degree of relaxation to thereby condition at least a portion of the bulk in the yarn, thereafter passing the yarn at a selected linear speed from the first heated zone through a second heated zone and a cooling zone while false twisting the yarn to thereby heat set the false twisted yarn, and finally collecting the processed yarn.

6. A method as set forth in claim 5 wherein said bulked yarn is provided with latent bulk which is developed during advancement of the yarn through said first heated zone.

7. A method as set forth in claim 6 wherein said yarn is ply twisted, and the step of false twisting includes false twisting the yarn in the same sense as the ply twist in the yarn.

8. A process as set forth in claim 5 wherein the step of false twisting the yarn includes twisting the yarn about its axis while precluding the yarn from twisting on itself to form pigtail deformations.

9. A method as set forth in claim 5 including the step of precluding migration of the twist in the yarn from said second heated zone to said first heated zone.

10. A method as set forth in claim 5 including the step of heating said second heated zone to a level to anneal said yarn after bulking and simultaneously permit the yarn to accept the twist imposing by said false twisting.

11. A method as set forth in claim 5 including the step of controlling the heat in said first and second zones in correlation to the rate of travel of the yarn through each of said zones.

12. A method as set forth in claim 5 including the steps of heating said second zone to a level to anneal the yarn after bulking and simultaneously permit the yarn to accept the twist imposed during said false twisting whereby after the yarn is passed through said cooling zone the yarn is heat-set in said twisted condition, and precluding the migration of the false twist in the yarn into said first heated zone.

13. A bulked and heat set yarn produced by the method of claim 5.

14. An apparatus for texturing yarn comprising first heating means for heating a moving strand of yarn to a temperature in the range of 160° to 200°C, second heating means downstream from said first heating means for heating said yarn during passage therethrough to a higher temperature than said first heating means, a cooling zone downstream from said second heating means, means for imparting a false twist to said moving yarn while said yarn is in said cooling zone and said second heating means, means for tensioning said moving yarn to a greater extent in said second heating means than in said first heating means, and means for collecting said moving yarn downstream from said false twisting means.

15. Apparatus for producing a bulked and heat set yarn comprising, a first heated zone, means for overfeeding a latently bulked ply twisted heat settable yarn into said first heated zone to thereby develop at least a portion of the bulk in the yarn, a second heated zone positioned to receive the yarn after passage through said first heated zone, false twisting means operable to twist the yarn in the same sense as the sense of the ply twist in the yarn before passage of the yarn through said second heated zone and to untwist the yarn after passage through the latter zone to thus heat set the yarn in the twisted configuration, means operable to control the tension in the yarn to a prescribed value while said yarn is twisted and untwisted by said false twist means, and means for collecting the thus processed yarn.

* * * * *